US008337376B2

(12) United States Patent
Liu

(10) Patent No.: US 8,337,376 B2
(45) Date of Patent: Dec. 25, 2012

(54) POST-PRESS APPARATUS AND A METHOD TO ACCOMPLISH HOT FOIL STAMPING, DIE-CUTTING AND BLANK SEPARATION IN A SINGLE PASS

(76) Inventor: Tian-Sheng Liu, Taipei (TW)

( * ) Notice: Subject to any disclaimer, the term of this patent is extended or adjusted under 35 U.S.C. 154(b) by 348 days.

(21) Appl. No.: 12/856,224

(22) Filed: Aug. 13, 2010

(65) Prior Publication Data

US 2012/0040814 A1 Feb. 16, 2012

(51) Int. Cl.
*B31B 1/14* (2006.01)

(52) U.S. Cl. ..... 493/342; 493/56; 493/58; 493/71; 493/373

(58) Field of Classification Search ..... 493/54–56, 493/58, 60, 71, 342, 357, 373
See application file for complete search history.

(56) References Cited

U.S. PATENT DOCUMENTS 4,466,318 A * 8/1984 Schoch ..... 83/62
4,466,320 A * 8/1984 Tokuno et al. ..... 83/325
4,604,083 A * 8/1986 Barny et al. ..... 493/34
4,767,393 A * 8/1988 Smith ..... 493/342
4,921,154 A * 5/1990 Abe et al. ..... 225/97
5,163,891 A * 11/1992 Goldsborough et al. ..... 493/321
5,348,285 A * 9/1994 Huser ..... 271/183
6,131,496 A * 10/2000 Schaede ..... 83/151
6,412,379 B1 * 7/2002 Turusaki ..... 83/155.1
2008/0108490 A1 * 5/2008 Kocherga et al. ..... 493/59
2008/0300120 A1 * 12/2008 Sato ..... 493/69

* cited by examiner

*Primary Examiner* — Thanh Truong
(74) *Attorney, Agent, or Firm* — Muncy, Geissler, Olds & Lowe, PLLC

(57) ABSTRACT

A post-press apparatus which advances paper once to accomplish processing of cotton boxes, includes a sheet feeder unit, a hot foil stamping unit, a die-cutting unit, a waste stripping unit, a blank separation unit, a waste conveying unit, a gripper bar and a gripper bar chain. The advantages are that works to be done by multiple apparatuses are accomplished on one apparatus, reducing a number of times of paper advancing to improve a production efficiency and decreasing staffs to reduce a labor cost; inaccuracy of repetitive positioning by multiple times of paper advancing is avoided, improving a processing quality and reducing a defect rate to decrease a loss.

13 Claims, 1 Drawing Sheet

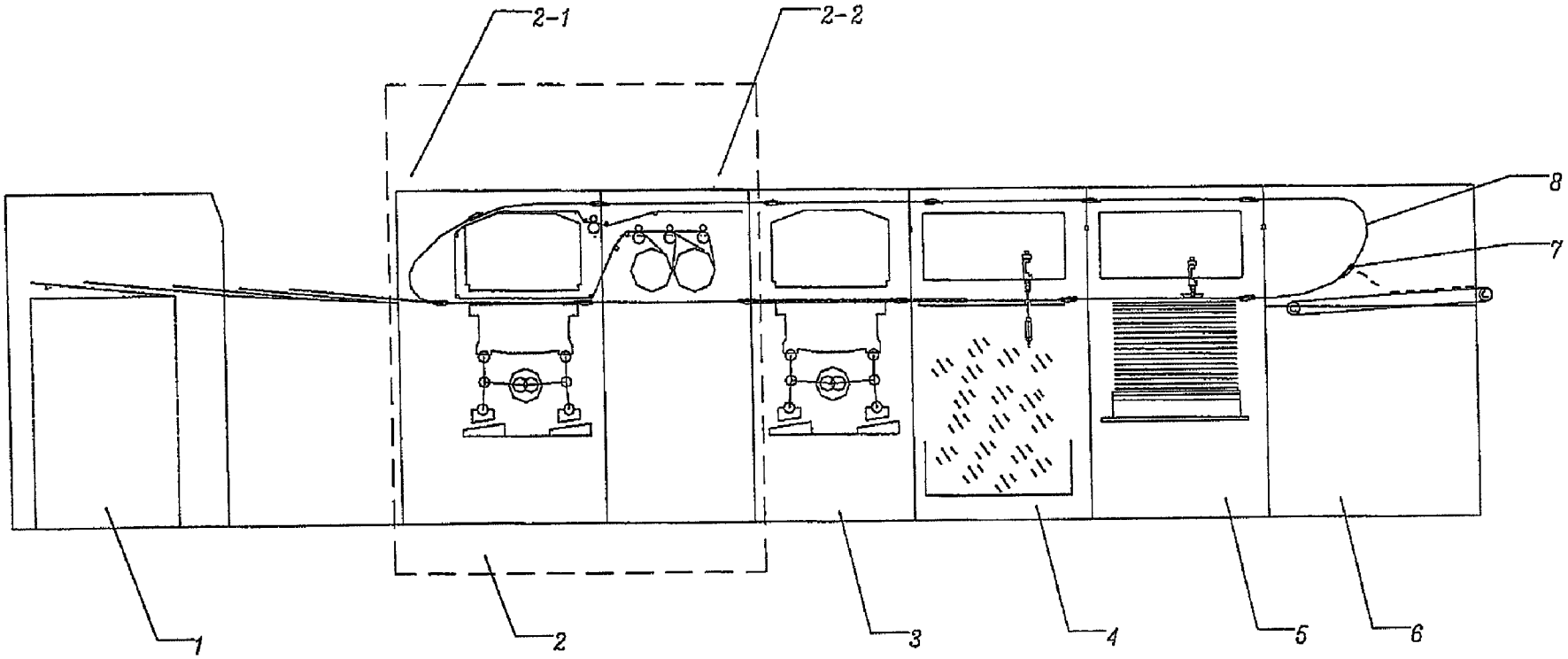
8
7
6
5
4
3
2-2
2-1
2
1

POST-PRESS APPARATUS AND A METHOD TO ACCOMPLISH HOT FOIL STAMPING, DIE-CUTTING AND BLANK SEPARATION IN A SINGLE PASS

BACKGROUND OF THE INVENTION a) Field of the Invention

The present invention relates to an automatic post-press apparatus and a working method thereof, and more particularly to a post-press apparatus and a method to accomplish hot foil stamping, die-cutting and blank separation in a single pass.

b) Description of the Prior Art

As rapid development of printing and packing industries, a demand in markets for a degree of automation of a post-printing processing apparatus is getting higher and higher. Pursuing a processing apparatus of high speed and precision to improve an efficiency of production, thereby taking up the markets, is the market demand and is also an inevitable trend of the development of the post-printing apparatus. A new post-printing processing apparatus was developed following the print and packaging industries' demand to become more competitive in a rapidly changing marketplace where increased labor and raw material costs erode the profitability of their companies. In order to address the situation, a unique new product was designed to improve production and reduce downtime, wherein an "added value" factor is redefined by creating a machine that applies multi processes, such as hot foil stamping, die cutting and blank separation in one pass.

For the die cutting machine with blank separation in the existing markets, only semi-finished products which have been hot foil stamped on other apparatuses can be performed with die-cutting, waste stripping, blank separation and waste conveying to achieve the (flat) carton blank. Obviously, this kind of machine is unable to fulfill the need of the markets that the (flat) carton blank are obtained in a single pass to accomplish the processing.

On the other hand, an existing multi-station die-cutting and hot foil stamping apparatus in the markets utilizes a multi-station die-cutting unit and a foil stamping and advance control unit to accomplish required multiple processes of hot foil stamping (or embossing) and die-cutting. However, after that, the multi-station die-cutting and hot foil stamping apparatus is only provided with a simple waste stripping function and is thus unable to accomplish bank separation. Besides, a sheet material after die-cutting cannot be distributed or be collected as carton blanks before an off-line blanking process, which is provided with a low efficiency and is easy to tear apart the carton blanks, thereby increasing non-conforming products. Apparently, this machine is unable to fulfill the need of the markets that the carton blanks are obtained in a single pass to accomplish the processing, either.

Accordingly, none of the existing technologies in the markets is able to meet the function that the carton blanks are obtained in a single pass on a same apparatus through hot foil stamping (once or twice), die-cutting, waste stripping, blank separation and waste conveying. The present invention provides an automatic post-press apparatus and a working method thereof to implement the aforementioned function, due to that the markets are imminently in need of a multi-station die-cutting and hot foil stamping apparatus with the blank separation function, in order to improve the efficiency of production.

SUMMARY OF THE INVENTION

The primary object of the present invention is to provide a post-press apparatus and a method that accomplishes hot foil stamping, die-cutting, waste stripping, blank separation and waste conveying in a single pass, wherein a single sheet of paper is transported once to acquire the finished carton blanks; in other words, the existing work that paper needs to be advanced in multiple times in separate hot foil stamping, die-cutting and blank separation machines to acquire the carton blanks is simplified, the work efficiency is largely improved and a quality of the products is assured effectively.

According to the present invention, the post-press apparatus which advances paper once to accomplish processing of the carton blanks includes a sheet feeder unit, a hot foil stamping unit, a die-cutting unit, a waste stripping unit, a blank separation unit, a waste conveying unit, a gripper bar and a gripper bar chain. An output end of the said sheet feeder unit is connected with an input end of the hot foil stamping unit, and the said hot foil stamping unit, die-cutting unit, waste stripping unit, blank separation unit and waste conveying unit are serially connected one by one, with the input and output ends between every two units being interconnected. The said gripper bar is at least one set and is fixedly connected on the gripper bar chain. The said gripper bar chain is a pair of chains, through the hot foil stamping unit, the die-cutting unit, the waste stripping unit, the blank separation unit and the waste conveying unit, forms a closed loop and is driven by a power mechanism. The said gripper bar grabs and pulls the paper sheet from the sheet feeder unit and transports the paper sheet orderly to the hot foil stamping unit, the die-cutting unit, the waste stripping unit, the blank separation unit and the waste conveying unit.

The aforementioned hot foil stamping unit includes a press unit and a foil advance control unit; the said press unit and foil advance control unit are orderly connected between the sheet feeder unit and the die-cutting unit.

A fixed platform and a movable platform of the aforementioned press unit can be installed with an embossing tool or a hot stamping tool.

The aforementioned press unit can be a platen-type, a rotary type or a flat-bed cylinder type.

The aforementioned hot foil stamping unit is at least one set.

The aforementioned sheet feeder unit transports a single sheet of paper to a position where the paper can be grabbed by the gripper bar.

The fixed platform and the movable platform of the aforementioned die-cutting unit are installed with a die-cutting tool.

The aforementioned die-cutting unit can be a platen-type, a rotary type or a flat-bed cylinder type.

A working method of the post-press apparatus which accomplishes processes of the carton blank in a single pass includes following steps:

(1) the sheet feeder unit transporting a single sheet of paper to an entrance of the hot foil stamping control unit and the gripper bar on the gripper bar chain opening the grippers to hold the paper which is in position;

(2) the gripper bar on the gripper bar chain transporting the paper to a processing position of the hot foil stamping unit, accomplishing the hot foil stamping or embossing orderly;

(3) the paper that has been hot foil stamped or embossed being transported by the gripper bar on the gripper bar chain to the die-cutting unit, accomplishing the carton die-cutting and creasing;

(4) the paper that has been die-cut and creased being transported by the gripper bar to the waste stripping unit, accomplishing waste stripping;

(5) the waste-stripped paper being transported by the gripper bar to the blank separation unit which completely collect carton blanks as a stack, thereby obtaining the finished products which are arranged neatly;

(6) the gripper bar holding the front waste and transporting to the waste conveying unit where the gripper bar drops the front waste to a transport belt below, with the front waste being transported out.

In the aforementioned step (5), the said finished products are flat carton blanks.

All the aforementioned sheet feeder unit, hot foil stamping unit (including the press unit and the foil advance control unit), die-cutting unit, waste stripping unit, blank separation unit, waste conveying unit, gripper bar and gripper bar chain belong to the known technologies and each unit accomplishes the procedure independently.

The present invention is provided with following advantages:

(1) works which are accomplished by multiple apparatuses being accomplished on one apparatus, reducing a number of times of paper advancing to improve the efficiency of production, and decreasing staffs to reduce a labor cost;

(2) avoiding inaccuracy of repetitive registering by multiple passes, improving a quality of processing and reducing a rate of defect to decrease a loss;

(3) interpreting new concept of post-printing to print industries, which is capable of performing a huge economic benefit to clients, enhancing competitiveness for clients, implementing mutual benefit and resource-sharing between industries and clients.

To enable a further understanding of the said objectives and the technological methods of the invention herein, the brief description of the drawings below is followed by the detailed description of the preferred embodiments.

BRIEF DESCRIPTION OF THE DRAWINGS

FIG. 1 shows a schematic view of structures of a post-press apparatus which accomplishes hot foil stamping, die-cutting and blank separation in a single pass.

DETAILED DESCRIPTION OF THE PREFERRED EMBODIMENTS

Referring to FIG. 1, a automatic post-press apparatus which advances paper once to accomplish processing of carton blanks comprises primarily a sheet feeder unit 1, a hot foil stamping unit 2, a die-cutting unit 3, a waste stripping unit 4, a blank separation unit 5, a waste conveying unit 6, a gripper bar 7 and a gripper bar chain 8. An output end of the said sheet feeder unit 1 is connected with an input end of the hot foil stamping unit 2. The said hot foil stamping unit 2, die-cutting unit 3, waste stripping unit 4, blank separation unit 5 and waste conveying unit 6 are serially connected one by one, with the input and output ends between every two units being interconnected. The said gripper bar 7 is at least one set and is fixedly connected on the gripper bar chain 8. The said gripper bar chain 8, through the hot foil stamping unit 2, the die-cutting unit 3, the waste stripping unit 4, the blank separation unit 5 and the waste conveying unit 6, forms a closed loop and is driven by a power mechanism. The said gripper bar 7 grabs and pulls the paper sheet from the sheet feeder unit 1 and transports the paper sheet orderly to the hot foil stamping unit 2, the die-cutting unit 3, the waste stripping unit 4, the blank separation unit 5 and the waste conveying unit 6.

The aforementioned hot foil stamping unit 2 includes a press unit 2-1 and a foil advance control unit 2-2; the said press unit 2-1 and foil advance control unit 2-2 are orderly connected between the sheet feeder unit 1 and the die-cutting unit 3.

A fixed platform and a movable platform of the aforementioned press unit 2-1 can be installed with an embossing tool or a hot stamping tool.

The aforementioned press unit 2-1 can be a platen type, a rotary type or a flat-bed cylinder type.

The aforementioned hot foil stamping unit 2 is one set.

The aforementioned sheet feeder unit 1 transports a single sheet of paper to a location where the paper can be grabbed by the gripper bar 7.

The fixed platform and the movable platform of the aforementioned die-cutting unit 3 are installed with a die-cutting tool.

The aforementioned die-cutting unit 3 can be a platen type, a rotary type or a flat-bed cylinder type.

A working method of the post-press apparatus which advances paper once to accomplish processing of the carton blanks includes following steps:

(1) the sheet feeder unit 1 transporting a single sheet of paper to an entrance of the hot foil stamping unit 2 and the gripper bar 7 on the gripper bar chain 8 opening the grippers to hold the paper which is in position;

(2) the gripper bar 7 on the gripper bar chain 8 transporting the paper to a processing location of the hot foil stamping unit 2, accomplishing the hot foil stamping or embossing orderly;

(3) the paper that has been hot foil stamped or embossed being transported by the gripper bar 7 on the gripper bar chain 8 to the die-cutting unit 3, accomplishing the carton die-cutting and creasing;

(4) the paper that has been die-cut and creased being transported by the gripper bar 7 to the waste stripping unit 4, accomplishing waste stripping;

(5) the waste stripped paper being transported by the gripper bar 7 to the blank separation unit 5 which completely collects carton blanks as a stack, obtaining the finished products which are arranged neatly;

(6) the gripper bar 7 holding the front waste and transporting to the waste conveying unit 6 where the gripper bar 7 drops the front waste to a transport belt below, with the front waste being transported out.

In the aforementioned step (5), the said finished products are flat carton blanks.

All the aforementioned sheet feeder unit 1, hot foil stamping unit 2 (including the press unit 2-1 and the foil advance control unit 2-2), die-cutting unit 3, waste stripping unit 4, blank separation unit 5, waste conveying unit 6, gripper bar 7 and gripper bar chain 8 belong to the known technologies and each unit accomplishes the procedure independently.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A post-press apparatus which advances paper once to accomplish processing of carton blanks products, comprising a sheet feeder unit, a hot foil stamping unit, a die-cutting unit, a waste stripping unit, a blank separation unit, a waste conveying unit, a gripper bar and a gripper bar chain, wherein an output end of the sheet feeder unit is connected with an input end of the hot foil stamping unit; the hot foil stamping unit, the die-cutting unit, the waste stripping unit, the blank separation unit and the waste conveying unit are serially connected one by one, with an output end and an input end between every two units being interconnected; the gripper bar is at least one set and is fixedly connected on the gripper bar chain; the gripper bar chain, through the hot foil stamping unit, the die-cutting unit, the waste stripping unit, the blank separation unit and the waste conveying unit, forms a closed loop and is driven by a power mechanism; the gripper bar grabs and pulls a sheet of paper from the sheet feeder unit and transports the paper sheet orderly to the hot foil stamping control unit, the die-cutting unit, the waste stripping unit, the blank separation unit and the waste conveying unit.

2. The post-press apparatus which advances paper once to accomplish processing of carton blanks, according to claim 1, wherein the hot foil stamping unit includes a press unit and a foil advance control unit which are orderly connected between the sheet feeder unit and the die-cutting unit.

3. The post-press apparatus which advances paper once to accomplish processing of carton blanks, according to claim 2, wherein a fixed platform and a movable platform of the press unit are installed with an embossing tool or a hot stamping tool.

4. The post-press apparatus which advances paper once to accomplish processing of carton blanks, according to claim 2, wherein the press unit is a platen type, a rotary type or a flat-bed cylinder type.

5. The post-press apparatus which advances paper once to accomplish processing of carton blanks, according to claim 3, wherein the press unit is a platen type, a rotary type or a flat-bed cylinder type.

6. The post-press apparatus which advances paper once to accomplish processing of carton blanks, according to claim 1, wherein the hot foil stamping unit is at least one set.

7. The post-press apparatus which advances paper once to accomplish processing of carton blanks, according to claim 2, wherein the hot foil stamping unit is at least one set.

8. The post-press apparatus which advances paper once to accomplish processing of carton blanks, according to claim 1, wherein the sheet feeder unit transports a single sheet of paper to a location where the paper is held by the gripper bar.

9. The post-press apparatus which advances paper once to accomplish processing of carton blanks, according to claim 1, wherein a fixed platform and a movable platform of the die-cutting unit are installed with a die-cutting tool.

10. The post-press apparatus which advances paper once to accomplish processing of carton blanks, according to claim 1, wherein the die-cutting unit is a platen type, a rotary type or a flat-bed cylinder type.

11. The post-press apparatus which advances paper once to accomplish processing of carton blanks, according to claim 9, wherein the die-cutting unit is a platen type, a rotary type or a flat-bed cylinder type.

12. A working method of the post-press apparatus which advances paper once to accomplish the processing of carton blanks, comprising following steps:

(1) the sheet feeder unit transporting a single sheet of paper to an entrance of the hot foil stamping unit, the gripper bar on the gripper bar chain opening the grippers to hold the paper which is in position;

(2) the gripper bar on the gripper bar chain transporting the paper to a processing location of the hot foil stamping unit, accomplishing hot foil stamping or embossing orderly;

(3) the paper, which has been hot foil stamped or embossed, being transported by the gripper bar on the gripper bar chain to the die-cutting unit, accomplishing the carton die-cutting and creasing;

(4) the paper, which has been die-cut and creased, being transported to the waste stripping unit for waste stripping;

(5) the waste stripped paper being transported by the gripper bar to the blank separation unit which completely collects carton blanks as a stack, thereby obtaining the finished products which are arranged neatly;

(6) the gripper bar holding the front waste and transporting to the waste conveying unit where the gripper bar drops the front waste onto a transporting belt below, with the front waste being transported out.

13. The working method of the post-press apparatus which advances paper once to accomplish the processing of carton blanks, according to claim 12, wherein the finished products in step (5) are flat carton blanks.

* * * * *